US007761951B1

(12) United States Patent
O'Neal, Jr.

(10) Patent No.: US 7,761,951 B1
(45) Date of Patent: Jul. 27, 2010

(54) ARTICULATED PAINT ROLLER ASSEMBLY

(76) Inventor: Kirk J. O'Neal, Jr., 2794 N. M-52, Stockbridge, MI (US) 49285

( * ) Notice: Subject to any disclaimer, the term of this patent is extended or adjusted under 35 U.S.C. 154(b) by 1036 days.

(21) Appl. No.: 11/459,805

(22) Filed: Jul. 25, 2006

(51) Int. Cl.
*B05C 17/02* (2006.01)

(52) U.S. Cl. ..... 15/230.11; 15/144.1; 492/13; 492/19

(58) Field of Classification Search ..... 15/144.1, 15/144.4, 145, 230.11, 172, 144.2; 492/13, 492/17, 19
See application file for complete search history.

(56) References Cited

U.S. PATENT DOCUMENTS 3,357,035 A 12/1967 Ficke
5,050,261 A 9/1991 Hofacker
5,207,755 A 5/1993 Ampian
5,860,902 A 1/1999 Jang et al.
6,016,586 A * 1/2000 Hsu ..... 15/144.1
6,412,138 B1 * 7/2002 MacMillan ..... 15/144.2

* cited by examiner

*Primary Examiner*—Shay L Karls
(74) *Attorney, Agent, or Firm*—Steve M. Clemmons

(57) ABSTRACT

An paint roller assembly having a paint roller and an elongated extension pole. The paint roller is coupled to the extension pole by a pivoting head that is selectively lockable at various user-selected angles. The pivoting head and paint roller include complementary seat and recess sections that always position the roller either parallel or perpendicular to the pivot head's axis of rotation.

13 Claims, 4 Drawing Sheets

ARTICULATED PAINT ROLLER ASSEMBLY

FIELD OF THE INVENTION

The present invention relates to paint rollers and, more particularly, to paint rollers having an articulated multi-position handle.

BACKGROUND OF THE INVENTION

Painters oftentimes use hand roller paint applicators having a nap-covered rolling sleeve or tube that is coated in paint. The paint is subsequently rolled onto the object desired to be painted. Ordinarily these objects have a large flat surface, e.g., a wall. These paint rollers provide a quick, reliable, and relatively inexpensive tool for applying paint to these surfaces.

In certain applications, the paint roller is mounted upon an extension rod or pole that allows a user to extend his reach and paint a larger surface area without using additional equipment such as ladders or scaffolding. While these extension poles do permit a user to paint areas that are otherwise difficult to reach, they are merely elongated straight handles that do not provide any flexibility to the user to paint around obstacles that may need to be avoided while painting.

For example, a painter may need to paint a portion of a wall that is above wall-mounted signs, cabinets, or shelves. Present, straight pole extensions will not easily allow the painter to reach the entire surface and the painter will normally have to climb a ladder to paint the areas that he cannot reach with the extension pole mounted paint roller.

The above-described secondary painting that must be done creates additional work for the painter and increases the likelihood of injury due to the painter having to "leave the ground" and climb upon a ladder or scaffold.

Previous attempts to overcome the limitation of straight pole extensions include U.S. Pat. Nos. 5,207,755 issued May 4, 1993 to Gregory J. Ampian for "Universally Adjustable Paint Roller"; 5,860,902 issued Jan. 19, 1999 to Bor-Zeng Bohr Jang et al. for "Paint Roller Frame with an Adjustable Handle"; 5,050,261 issued Sep. 24, 1991 to Roland J. Hofacker for "Angularly Adjustable Adapter for Paint Rollers"; 3,357,035 issued Dec. 12, 1967 to Ralph Ficke for "Brush and Roller Extension Pole". None of these prior art patents, however, provide a paint roller assembly that, among other advantages, is positionable at multiple angles and includes a locking mechanism that is biased in the locked position to ensure that the paint roller stays at the selected angle.

SUMMARY OF THE INVENTION

The present invention is a paint roller assembly having a paint roller and a pivoting extension handle. The assembly includes at least one extension pole that is selectively coupled to a pivoting head that receives the extension pole at one end and is coupled to the paint roller at the other end. The pivoting head includes a locking pin assembly that allows a user to select the angle the paint roller is positioned relative to the pole held by the user, i.e., the handle.

It is an advantage of the present invention to provide a paint roller assembly including an elongated pole-type handle; a paint roller having a roller sleeve that rotates about a first axis; and a pivoting assembly that pivotally couples the handle to the paint roller, wherein the pivoting assembly rotates about a second axis that is either parallel or perpendicular to the first axis.

It is another advantage of the present invention to provide a paint roller assembly including an elongated generally cylindrical handle; a pivot assembly having a handle end and a roller end, wherein the roller end is pivotally coupled to the handle end along a first axis, and the handle end is removably coupled to the handle; a locking assembly having a pivot assembly engagement portion that is movable from an open position where the engagement portion is remote from the pivot assembly and a closed position where the engagement portion engages the pivot assembly, the locking assembly is coupled to one of the two pivot assembly ends whereby the engagement portion is positioned to engage the other pivot assembly end; and a paint roller having a grip, a frame and a roller sleeve that is rotatably coupled to the frame perpendicular to the grip along a second axis, the paint roller is removably coupled to the roller end at the grip and the first and second axes are either parallel or perpendicular.

It is still another advantage of the present invention to provide a paint roller assembly having complementary hex-shaped fittings on the paint roller grip and pivoting assembly, thereby preventing the paint roller from rotating upon the pivoting assembly.

It is yet another advantage of the present invention to provide a paint roller assembly having at least one quick-disconnect locking clip that is biased in a closed or locked position, the clips may be used to couple the paint roller to the pivoting assembly and for locking the pivoting assembly at a user-selected angle.

It is still yet another advantage of the present invention to provide a paint roller assembly having a pivoting member that may be readily disassembled from an extension pole and paint roller thereby allowing a user to easily transport the components of the paint roller assembly and allowing for additional extensions or pivoting members to be added.

These and other objects, features and advantages of the present invention will become apparent from the following description when viewed in accordance with the accompanying drawings and appended claims.

BRIEF DESCRIPTION OF THE DRAWINGS

The description refers to the accompanying drawings in which like reference characters refer to like parts throughout the several views, and in which.

DETAILED DESCRIPTION OF THE INVENTION

Figure 1:
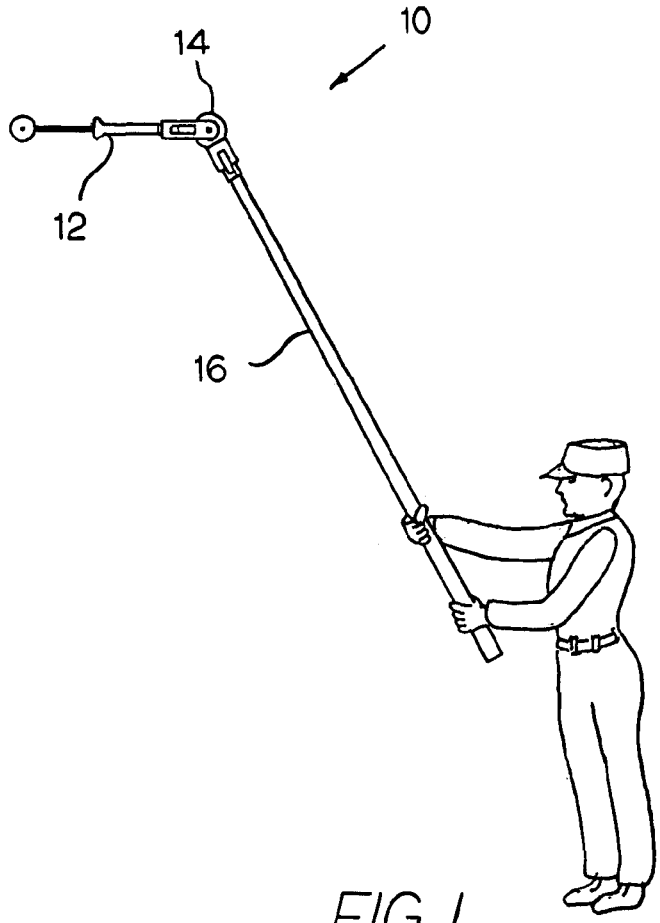
FIG. 1 is a side view of the preferred embodiment of the articulated paint roller assembly in use by a painter.

Referring to FIG. 1, a preferred embodiment of an articulated paint roller assembly 10 is shown. Assembly 10 includes a paint roller 12, a pivot assembly 14, and an extension pole or handle 16.

Figure 8:
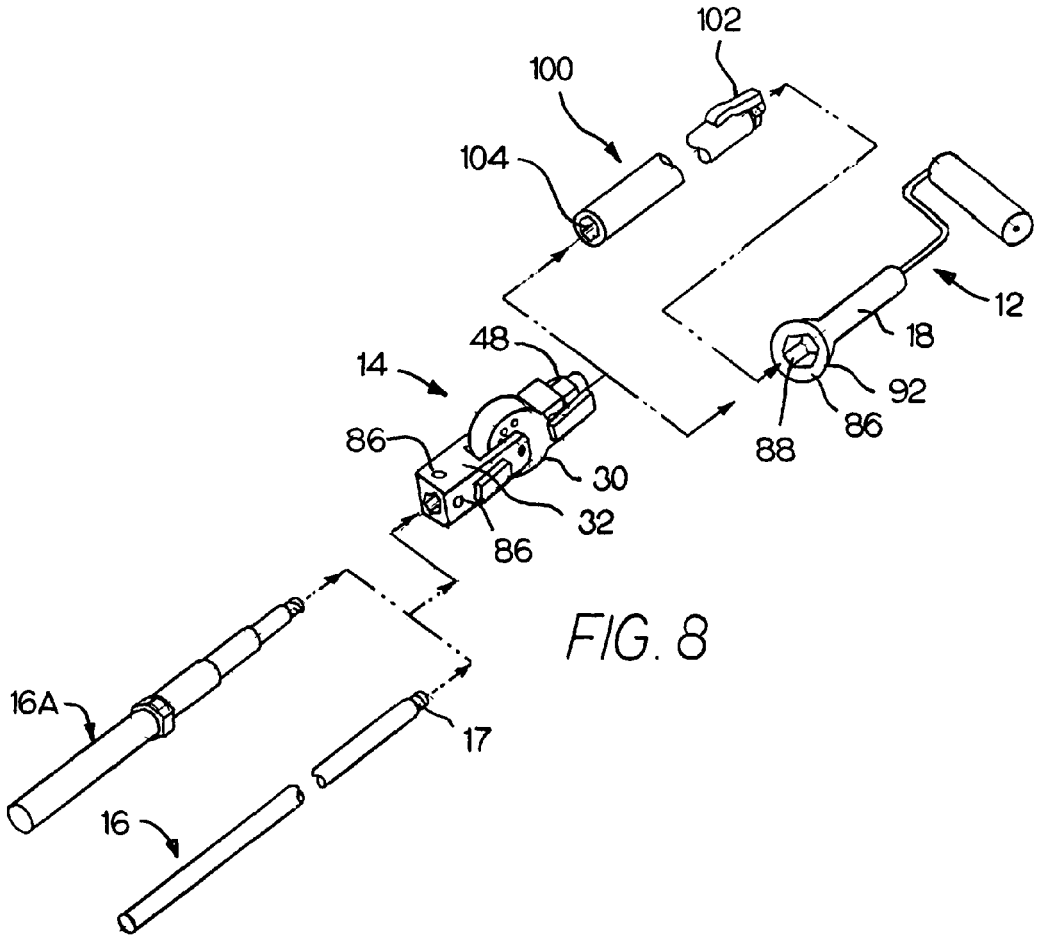
FIG. 8 is a partially exploded view of the articulated paint roller assembly, including alternate extension poles.

In the preferred embodiment, extension pole 16 is a conventional elongated "broom-handle" style pole or rod having a male fastener end 17. In another embodiment, as shown in FIG. 8, pole 16 may be replaced with a conventional telescopic or extensible pole 16A having a number of concentric cylindrical members that cooperate to allow a user to vary the length of the extension handle 16A.

Paint roller 12 is essentially a conventional paint roller having a generally cylindrical hand grip or handle 18, a wire body 20 that extends from one end of the grip 18, and a roller frame 22 that is rotatably coupled to wire body 20. Frame 22 is sized to fit within and retain conventional nap-covered tube-shaped paint applicators 24. In the preferred embodiment, frame 22 and applicator 24 are co-planar with grip 18 and are oriented perpendicular to the longitudinal axis of grip 18. As will be discussed in greater detail below, paint roller 12 differs from conventional paint rollers only in the configuration of the bottom extension-receiving end of grip 18.

Figure 2:
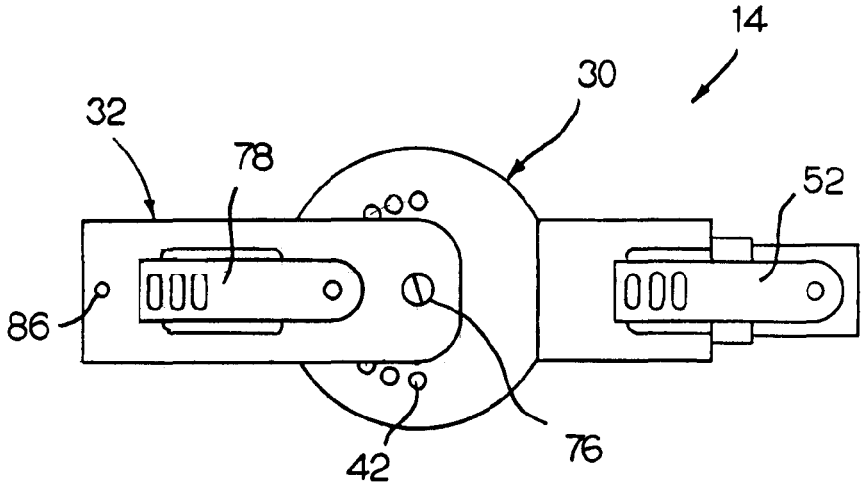
FIG. 2 is a side view of the pivot assembly of the preferred articulated paint roller assembly.
Figure 3:
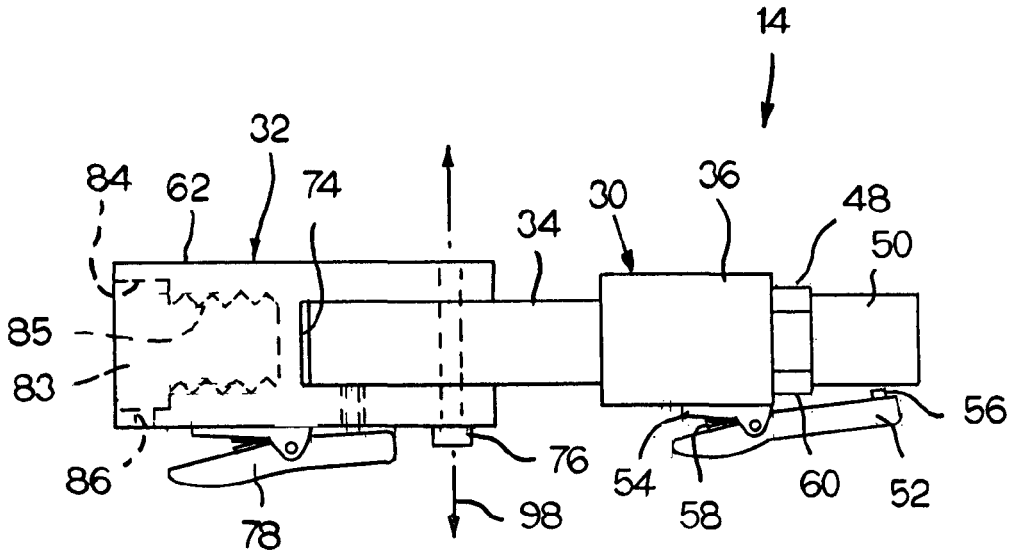
FIG. 3 is top view of the pivot assembly.
Figure 4:
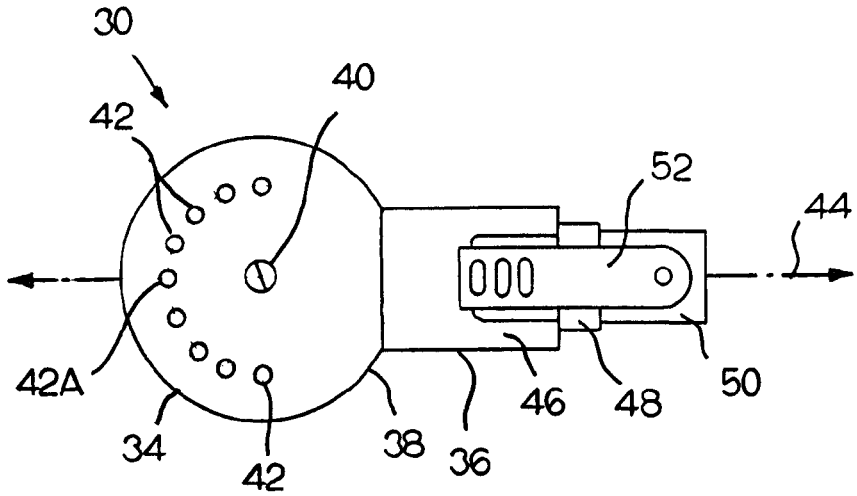
FIG. 4 is a side view of the roller-receiving end of the pivot assembly.
Figure 5:
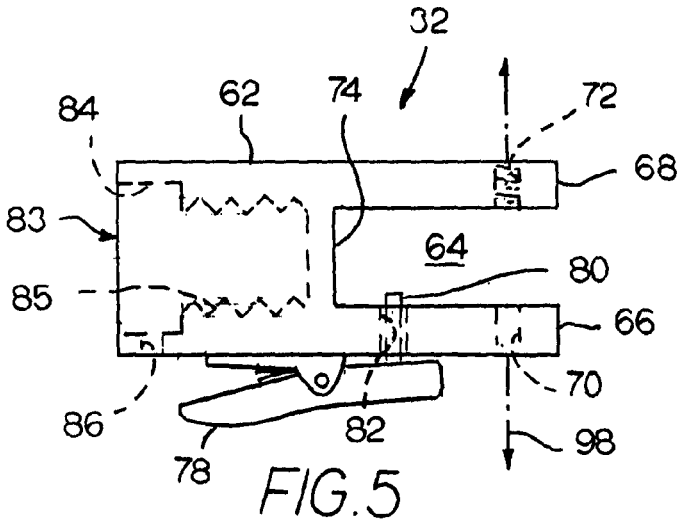
FIG. 5 is a side view of the extension-receiving end of the pivot assembly.
Figure 6:
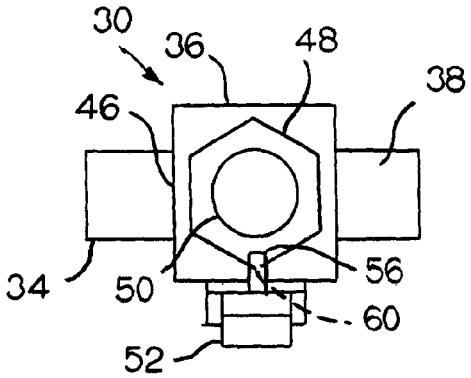
FIG. 6 is a front view of the roller-receiving end of the pivot assembly.

Referring now to FIGS. 2-6, pivot assembly 14 is preferably formed from two pivotally coupled bodies or ends 30 and 32. As best shown in FIGS. 4 and 6, roller-receiving end 30 has a disc-shaped portion 34 and a male extension 36 that projects from the curved side 38 of disc 34. Disc 34 is generally circular and has a bore 40 passing through its center. A number of angular-location bores 42 are also formed through disc 34 running parallel to bore 40. Location bores 42 are preferably positioned around bore 40 in the shape of a semicircle and each bore 42 is located an equal distance from bore 40 and these bores 42 are spaced at equal angles. One of the bores 42A is centrally disposed relative to the other location bores 42 and, like center bore 40, intersects a longitudinal axis 44 passing through the center of extension 36. In the preferred embodiment, nine location bores 42 are formed in disc 34, these bores are spaced across a one-hundred-eighty degree semi-circle (i.e., are spaced 22.5 degrees apart).

Extension 36 includes a generally rectangular member 46 that projects from the side of disc 34. A hexagonal seat 48 extends from the outer end of member 46. Further, a cylindrical plug 50 projects from seat 48. In the preferred embodiment, seat 48 and plug 50 are both centered along axis 44.

A quick-disconnect locking assembly or clip 52 is mounted upon one of the sides of member 46. In the preferred embodiment, clip 52 has a lever arm 54 that is pivotally coupled to a base 54. The clip 52 is disposed upon member 46 such that one end of arm 54 is positioned above the cylindrical plug 50. A cylindrical retention pin 56 extends down from arm 54 in the direction of plug 50. It should be appreciated that clip 52 is located upon member 46 such that pin 56 is substantially tangent to the curved surface of plug 50. A spring 56 biases the arm 54 so that pin 56 is forced downward in a closed position, i.e., in the direction of plug 50.

As shown best in FIGS. 3 and 6, hexagonal seat 48 projects from member 46 such that the corner 60 where two of the hex-faces meet is oriented to be co-planar with the centerline of pin 56 and axis 44.

Pivoting assembly 14 also includes an extension-receiving end 32. Extension receiving end 32, as best shown in FIGS. 2 and 5, has a generally rectangular body 62 having a yoke or channel 64 formed through one end to create a pair of parallel spaced flanges 66, 68. Yoke 64 is sized to slidably receive disc 34. Axially aligned bores 70, 72 are formed through the respective flanges 66, 68 near their outer edges. Flanges 66 and 68 extend from body 62 such that when bores 70 and 72 are axially aligned with center bore 40, a small gap exists between side 38 of disc 34 and the bottom wall 74 of yoke 64.

A pin or fastener 76 pivotally couples roller-receiving end 30 to extension-receiving end 32 through aligned bores 70, 40 and 72. It should be appreciated that one of the bores 70, 72 may be threaded to accommodate an externally threaded fastener, such as a bolt.

Extension-receiving end 32 also includes a quick-disconnect locking assembly or clip 78 that is substantially the same as clip 52 discussed above. Clip 78 includes an angular-location pin 80, similar to pin 56, and is mounted upon body 62 such that pin 80 overhangs a through-bore 82 formed in flange 66. Bore 82 is located within flange 66 such that, when fastener 76 couples ends 30 and 32 together, pin 80 is aligned with one of the location bores 42. It should be appreciated that pin 80 extends from the bottom of the arm of clip 78 to pass through bore 82 and at-least partially into one of the location bores 42. Further, pin 80 and bores 42 are complementarily sized (e.g., slip fit) so that pin 80 is effective to lock the pivoting ends 30, 32 at a fixed angular position.

Member 62 includes an extension pole-receiving bore 83 formed in the end opposite to wall 74. Bore 83 preferably includes a first hex-shaped "quick-connect" recess 84 and a deeper threaded portion 85 to couple end 32 to a conventional extension pole having either a hex-shaped seat that is identical to seat 48 or external threading disposed on male fastener end 17. As best shown in FIG. 8, two perpendicular pin locating holes 86 are formed in the outer surface of extension receiving end 32 adjacent to and running perpendicular to the opening of bore 83. These holes 86 are positioned around end 32 having their longitudinal axes perpendicular to each other.

Figure 7:
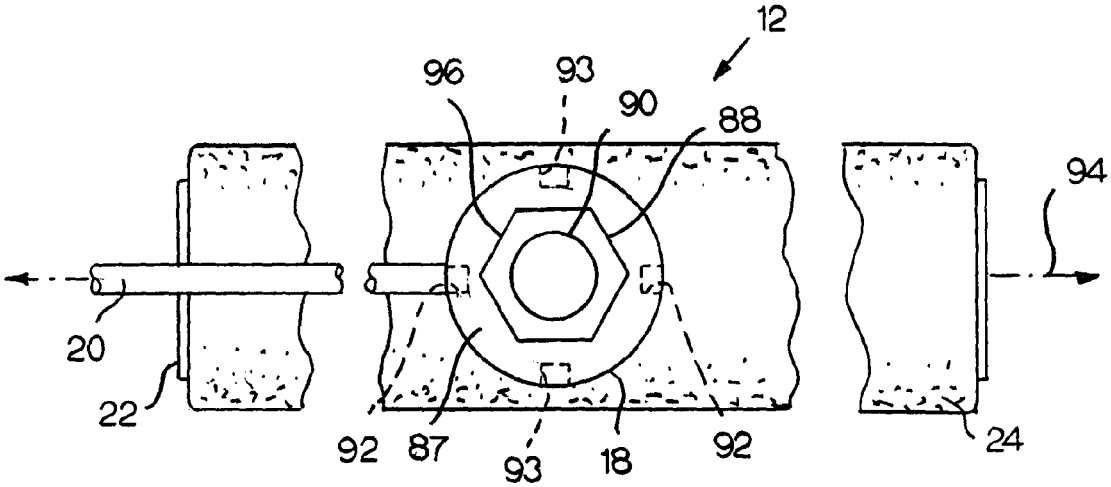
FIG. 7 is a rear view of the paint roller.

Referring now to FIGS. 7 and 8, the bottom end 87 of paint roller grip 18 is shown. Centered upon end 87 is a hexagonal-shaped recessed portion 88 that is complementary to seat 48. That is, recessed portion 88 is approximately sized to create a slip fit with seat 48. Similarly, a cylindrical bore 90 sized to receive plug 50 is formed at the bottom of hex-shaped recess 88. These hex-shaped fittings 48, 88 are complementarily shaped to permit paint roller 12 to be placed upon roller-receiving end 30 and cooperate to prevent the paint roller 12 from rotating upon end 30.

Further, at least one roller-locking bore 92, 93 is formed within grip 18 proximate to end 87 and tangent to bore 90 (i.e., perpendicular to the longitudinal axis of grip 18). In the preferred embodiment, two bores are positioned upon grip 18 so that the centerlines of these bores 92 are parallel to and co-planar with the rotational axis 94 of sleeve 22 and roller 24. Like corner 60 of seat 48, two of the faces forming hex-shaped recess 88 meet at a corner 96. The line defined by corner 96 is co-planar with axis 94. It should be appreciated that each roller-locking bore 92 is sized to complement pin 56. In this manner, paint roller 12 can be selectively fixed to roller-receiving end 30 so that axis 94 of the paint roller 12 is fixed in a position that is always parallel to the axis 98 of the pivot member (i.e., fastener 76) of the pivoting assembly 14.

Additionally, two additional bores 93 are positioned upon grip 18 so that the centerline of these bores 93 are perpendicular to the rotational axis 94 of sleeve 22 and roller 24. In this manner, paint roller 12 can be selectively fixed to roller-receiving end 30 so that axis 94 of the paint roller 12 is fixed in a position that is always perpendicular to the axis 98 of the pivot member (i.e., fastener 76) of the pivoting assembly 14.

Figure 9:
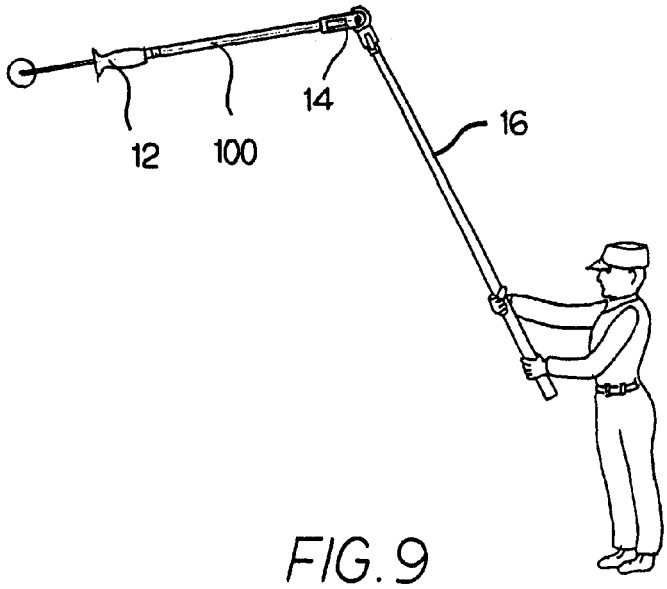
FIG. 9 is a side view of an alternate embodiment of the articulated paint roller assembly having a second extension pole in use by a painter.

In another embodiment of the invention, shown in FIGS. 8 and 9, a second extension pole 100 may be disposed between paint roller 12 and pivoting assembly 14. Pole 100 has a first end 102 that is substantially the same as male extension 36 of pivoting assembly 14, including a quick-disconnect clip, hexagonal seat and cylindrical plug. The opposite end 104 of pole 100 is identical to the bottom 86 of paint roller grip 18, including a hex-shaped recess, a plug-sized bore and pin-locking bore.

The invention has been described in an illustrative manner, and it is to be understood that the terminology, which has been used, is intended to be in the nature of words of description rather than of limitation.

Many modification and variations of the present invention are possible in light of the above teachings. It is, therefore, to be understood that within the scope of the appended claims, the invention may be practiced other than as specifically described. For example and without limitation, seat 48 and recess 88 may be substantially any complementary shaped fittings that positively prevent the paint roller from rotating around the pivot assembly.

Having described my invention, I claim:

1. A paint roller assembly comprising:

an elongated pole-type handle;

a paint roller having a roller sleeve that rotates about a first axis;

a pivot head comprising:

a yoke with two parallel spaced flanges extending from one end, said yoke having a hexagonally-shaped recess adjacent to an end opposite to said flange end, an internally threaded bore is formed concentrically into said yoke within a bottom of said hexagonally-shaped recess; and a roller-receiving body having a disc portion at one end which is rotatably coupled to the yoke between the flanges about a second axis, and a male extension projecting from said disc portion, said male extension including a seat having a hexagonal cross-section and a cylindrical plug extending concentrically from an end face of said hexagonal seat; and means for selectively locking said paint roller in one of two positions relative to said pivot head;

wherein a first locking position has said first axis parallel to said second axis and wherein a second locking position has said first axis perpendicular to said second axis.

2. The paint roller assembly of claim 1 wherein the paint roller includes a hex-shaped recess that is shaped complementary to said hexagonal seat and a cylindrical bore that is shaped complementary to said cylindrical plug.

3. The paint roller assembly of claim 1 wherein said locking means includes quick-disconnect means for selectively locking the paint roller to the pivot means.

4. The paint roller assembly of claim 3 wherein said quick-disconnect means includes a pivotable arm having a pin that is sized to fit within an aperture formed in a grip of said paint roller.

5. The paint roller assembly of claim 3 wherein said quick-disconnect means is movable from a closed position to an open position and is biased in said closed position.

6. The paint roller assembly of claim 1 wherein said elongated pole-type handle is a first handle, said paint roller assembly further comprising a second elongated pole-type handle coupling said paint roller to said pivot head.

7. The paint roller assembly of claim 6 further comprising complementary hex-shaped fittings on opposing ends of said second handle.

8. The paint roller assembly of claim 1 wherein said elongated handle is telescopic.

9. The paint roller assembly of claim 1 wherein the disc portion includes a plurality of apertures that are evenly spaced about said second axis.

10. The paint roller assembly of claim 9 further comprising a locking clip coupled to said pivot head, said clip including a pivoting arm and a pin extending downwardly from said arm, wherein said pin creates an interference fit within one of said plurality of apertures.

11. A paint roller assembly comprising:

an elongated generally cylindrical handle;

a pivot assembly comprising:

a handle-engaging body having a first pivot end and a handle receiving portion opposite to said first pivot end, said handle receiving portion having a hexagonally-shaped recess adjacent to an outer end of the handle receiving portion, an internally threaded bore is formed concentrically within a bottom of said hexagonally-shaped recess;

a paint roller-engaging body having a second pivot end and an adapter opposite to said second pivot end, said adapter including a seat having a hexagonal cross-section projecting from an outer end of said adapter and a cylindrical plug extending concentrically from an end face of said hexagonal seat; and means for pivotally coupling said first pivot end to said second pivot end;

a locking assembly having a pivot assembly engagement portion that is movable from an open position where the engagement portion is remote from the pivot assembly and a closed position where the engagement portion engages the pivot assembly, said locking assembly is coupled to one of the two pivot assembly ends whereby said engagement portion is positioned to engage the other pivot assembly end; and a paint roller having a grip, a frame and a roller sleeve that is rotatably coupled to the frame perpendicular to said grip along a second axis, the paint roller is removably coupled to said roller end at said grip whereby said paint roller is fixed in one of two positions;

wherein a first of said two positions has said first and second axes in parallel and wherein a second of said two positions has said first and second axes perpendicular to each other.

12. The paint roller assembly of claim 11 wherein said grip includes a hexagonal recess that is complementary in shape to said hexagonal seat and a cylindrical bore that is complementary in shape to said cylindrical plug, where said hexagonal seat and hexagonal recess cooperate to prevent rotational movement relative to each other.

13. The paint roller assembly of claim 12 wherein the pivot assembly body that is not coupled to said locking assembly includes a plurality of apertures that are axially spaced about said second axis, wherein said locking assembly includes a pin that is complementarily-shaped with each of said plurality of apertures.

* * * * *